US008528873B2

(12) United States Patent
Domenig et al.

(10) Patent No.: US 8,528,873 B2
(45) **Date of Patent: *Sep. 10, 2013**

(54) ROTARY SHELF SYSTEM

(75) Inventors: Georg Domenig, Kernersville, NC (US); Bret Schaller, Sanford, NC (US)

(73) Assignee: Rev-A-Shelf Company, LLC, Jeffersontown, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/051,365

(22) Filed: Mar. 18, 2011

(65) Prior Publication Data

US 2011/0163056 A1 Jul. 7, 2011

Related U.S. Application Data

(63) Continuation of application No. 11/677,753, filed on Feb. 22, 2007, now Pat. No. 7,922,016.

(60) Provisional application No. 60/775,717, filed on Feb. 23, 2006.

(51) Int. Cl.
*A47G 29/02* (2006.01)

(52) U.S. Cl.
USPC ..... 248/239; 248/235; 248/354.5; 211/70

(58) Field of Classification Search
USPC ..... 211/144, 163, 131.1, 95, 115, 70, 211/70.1, 70.2, 70.3, 70.4, 70.5, 70.6, 70.7; 411/513, 351, 316, 166; 248/224.7, 236, 248/243, 241, 354.5, 410, 125.8, 289.31, 248/417, 418, 145, 235, 239; 16/313, 315, 16/318, 314, 316, 317; 49/235, 236, 237, 49/239; 108/103; 312/238
See application file for complete search history.

(56) References Cited

U.S. PATENT DOCUMENTS

| | | | | |
|---|---|---|---|---|
| 121,155 | A | 11/1871 | Case | |
| 274,087 | A * | 3/1883 | Danner | 108/105 |
| 639,337 | A | 12/1899 | Anthony | |
| 1,446,449 | A * | 2/1923 | Carpenter et al. | 16/315 |
| 1,474,847 | A | 11/1923 | Phillips et al. | |
| 1,584,085 | A * | 5/1926 | England | 248/145 |
| 1,630,200 | A * | 5/1927 | Merrill | 49/42 |
| 1,908,797 | A | 5/1933 | Svalland | |
| 2,008,180 | A * | 7/1935 | Karnes | 211/193 |
| 2,589,482 | A | 3/1952 | Downey | 287/52.08 |
| 2,629,643 | A | 2/1953 | Davidson | 312/238 |
| 2,637,613 | A | 5/1953 | Motter | 312/238 |
| 2,685,353 | A * | 8/1954 | Caskie | 403/108 |
| 2,693,401 | A | 11/1954 | Brown | 312/238 |
| 2,698,776 | A | 1/1955 | Stoeckl | 312/238 |
| 2,755,698 | A | 7/1956 | Wurzel | 85/8.8 |
| 2,777,585 | A | 1/1957 | Jorgensen | 211/139 |
| 2,831,582 | A | 4/1958 | Cody | 211/146 |
| 2,951,593 | A * | 9/1960 | Lake | 108/139 |
| 3,019,912 | A | 2/1962 | Hoffman | 211/144 |

(Continued)

*Primary Examiner* — Terrell McKinnon
*Assistant Examiner* — Eret McNichols
(74) *Attorney, Agent, or Firm* — Brinks Hofer Gilson & Lione

(57) ABSTRACT

A shelf system is shown and described. A post has an aperture. A pin is configured to extend through that aperture. The pin has a head having a first circumference and a body having a second circumference. A collar is configured to encircle the post and rest on the pin head and body. In operation the collar, and any associated shelf, is able to rotate smoothly and stably around the post.

5 Claims, 11 Drawing Sheets

(56) References Cited

U.S. PATENT DOCUMENTS

| | | | | | |
|---|---|---|---|---|---|
| 3,127,994 | A | | 4/1964 | Campbell | 211/144 |
| 3,160,453 | A | | 12/1964 | Tassell | 312/238 |
| 3,222,806 | A | * | 12/1965 | Martin | 49/237 |
| 3,229,940 | A | * | 1/1966 | Kagels | 248/124.1 |
| 3,266,857 | A | | 8/1966 | Anderson | 312/252 |
| 3,281,197 | A | | 10/1966 | Anderson | 312/305 |
| 3,367,613 | A | * | 2/1968 | Christensen | 248/145 |
| 3,435,959 | A | | 4/1969 | Berman et al. | 211/163 |
| 3,628,844 | A | | 12/1971 | Preston | 312/305 |
| 3,658,369 | A | | 4/1972 | Barnes | 287/52.08 |
| 3,868,156 | A | | 2/1975 | Vander Ley | 312/238 |
| 3,982,800 | A | | 9/1976 | Gorton et al. | 312/305 |
| 4,146,280 | A | | 3/1979 | Crownhart | 312/305 |
| 4,181,037 | A | | 1/1980 | Boon et al. | 74/569 |
| 4,418,970 | A | | 12/1983 | Hyder et al. | 312/305 |
| 4,433,885 | A | | 2/1984 | Baker | 312/305 |
| 4,440,459 | A | | 4/1984 | Hallgren | 312/238 |
| 4,486,106 | A | | 12/1984 | Benting | 384/248 |
| 4,572,595 | A | | 2/1986 | Craig | 312/305 |
| 4,587,908 | A | | 5/1986 | DeBruyn | 108/142 |
| 4,616,940 | A | | 10/1986 | DeBruyn | 384/248 |
| 4,688,686 | A | | 8/1987 | Mitts et al. | 211/183 |
| 4,693,188 | A | * | 9/1987 | Twellmann | 108/139 |
| 4,738,495 | A | | 4/1988 | Mitts | 312/305 |
| 4,752,057 | A | * | 6/1988 | Hagemes | 248/354.5 |
| 5,050,746 | A | | 9/1991 | Frankel | 211/34 |
| 5,169,220 | A | | 12/1992 | Herr et al. | 312/305 |
| 5,244,270 | A | | 9/1993 | Parker | 312/270.2 |
| 5,273,353 | A | | 12/1993 | Twellmann | 312/238 |
| 5,279,429 | A | | 1/1994 | Sagel | 211/131 |
| 5,308,207 | A | | 5/1994 | Jaskowiak | 411/513 |
| 5,312,003 | A | | 5/1994 | Domenig | 211/144 |
| 5,326,065 | A | * | 7/1994 | Jackson | 248/351 |
| 5,357,871 | A | * | 10/1994 | Bowman | 108/27 |
| 5,374,117 | A | | 12/1994 | Herr et al. | 312/238 |
| 5,494,346 | A | | 2/1996 | Domenig | 312/238 |
| 6,010,927 | A | * | 1/2000 | Jones et al. | 438/210 |
| 6,016,927 | A | * | 1/2000 | Krupp | 211/126.2 |
| 6,017,108 | A | | 1/2000 | Domenig | 312/305 |
| 6,273,531 | B1 | | 8/2001 | Scheffer | 312/196 |
| RE37,943 | E | | 12/2002 | Domenig | 312/305 |
| 6,568,894 | B2 | * | 5/2003 | Golden et al. | 411/351 |
| 6,626,305 | B2 | | 9/2003 | Domenig et al. | 211/144 |
| 6,991,305 | B2 | | 1/2006 | Gallea | 312/238 |
| RE39,917 | E | | 11/2007 | Domenig et al. | 211/144 |
| 8,356,953 | B2 | * | 1/2013 | Sagel | 403/348 |
| 2004/0040479 | A1 | | 3/2004 | Searer et al. | 108/92 |
| 2005/0199159 | A1 | | 9/2005 | Searer | 108/94 |
| 2011/0127228 | A1 | * | 6/2011 | Sagel | 211/144 |

* cited by examiner

ROTARY SHELF SYSTEM

CROSS-REFERENCE TO RELATED APPLICATIONS

This application is a continuation of application Ser. No. 11/677,753 filed Feb. 22, 2007 now U.S. Pat. No. 7,922,016, which claims benefit to provisional application Ser. No. 60/775,717 filed Feb. 23, 2006.

FIELD

The present invention relates to a rotary shelf construction and assembly and, more particularly, to a fixed-post rotary shelf construction and assembly. Even more particularly, the present invention relates to improving the rotation and stability of fixed-post rotary shelf systems.

RELATED ART

Corner cabinets, e.g., corner kitchen cabinets, are common features in most houses or businesses. These cabinets offer significant storage space that is commonly difficult to access because of the depth or shape of the cabinet. Rotary shelving or "Lazy Susan" type shelving is often utilized to enhance access to the space contained within corner cabinets. Rotary shelves typically come in two types, rotating-post types and fixed-post types. With rotating-post types of rotary shelves, the shelf is fixedly attached to the rotating post to achieve shelf rotation within the cabinet. With fixed-post types of rotary shelves, the shelf is allowed to rotate around the fixed post to achieve shelf rotation. Each of these types of rotary shelves also commonly has a desired rest-position for the shelf. For example, a rest-position may be a position along the rotation of the shelf that is somewhat resistant to rotation and used to maintain the shelf at a particular location. Rest-positions are desirable, for example, for proper cabinet door positioning or simply to allow for a reference point for positioning or locating items on a shelf.

The fixed-post type of rotary shelf has historically had drawbacks. For example, they are either unable to rotate a full 360 degrees smoothly or without a bump at 180 degrees from the rest-position, or they are unable to adequately distribute the load of the shelf. Some, for example, in an effort to distribute the load of the shelf evenly, have constructed shelves that rotate on dual contact points. With this type of construction, shelves have a desired first rest-position, e.g., at 0 degrees, and an undesirable second rest-position or bump, e.g., at 180 degrees. This second "bump" disrupts operation and can cause items stored on shelves to topple during rotation. To address this problem, others have constructed shelves that rotate on a single contact point, which allows for only a single rest-position. These shelves, however, fail to evenly distribute the shelf load on both sides of the post, and thus lead to an unstable or un-level shelf.

It is to these, and other, problems that the present invention is directed.

SUMMARY

An object of the present invention is, therefore, to provide a rotary shelf that can rotate a full 360 degrees with only a single rest-position;

Another object of the present invention is to provide a rotary shelf that rotates smoothly and in a substantially level position;

Still another object of the present invention is to provide a rotary shelf that rotates on dual contact points;

A further object of the present invention is to provide a fixed-post type of rotary shelf that rotates on dual contact points and that can rotate a full 360 degrees with only a single rest-position;

Still another object of the present invention is to provide a rotary shelf system that is easy to manufacture and install.

To summarize, one embodiment of the invention includes a shelf system for use with a post having an aperture. The system includes a pin having a head having a first circumference, and a body having a second circumference smaller than the first circumference. The body of the pin includes a portion configured to extend through the aperture of the post. The system also includes a collar configured to encircle the post and rest on the pin head and on the portion of the pin body extended through the post.

Certain embodiments of the invention are set forth in more detail below.

DETAILED DESCRIPTION OF THE DRAWINGS

Figure 1:
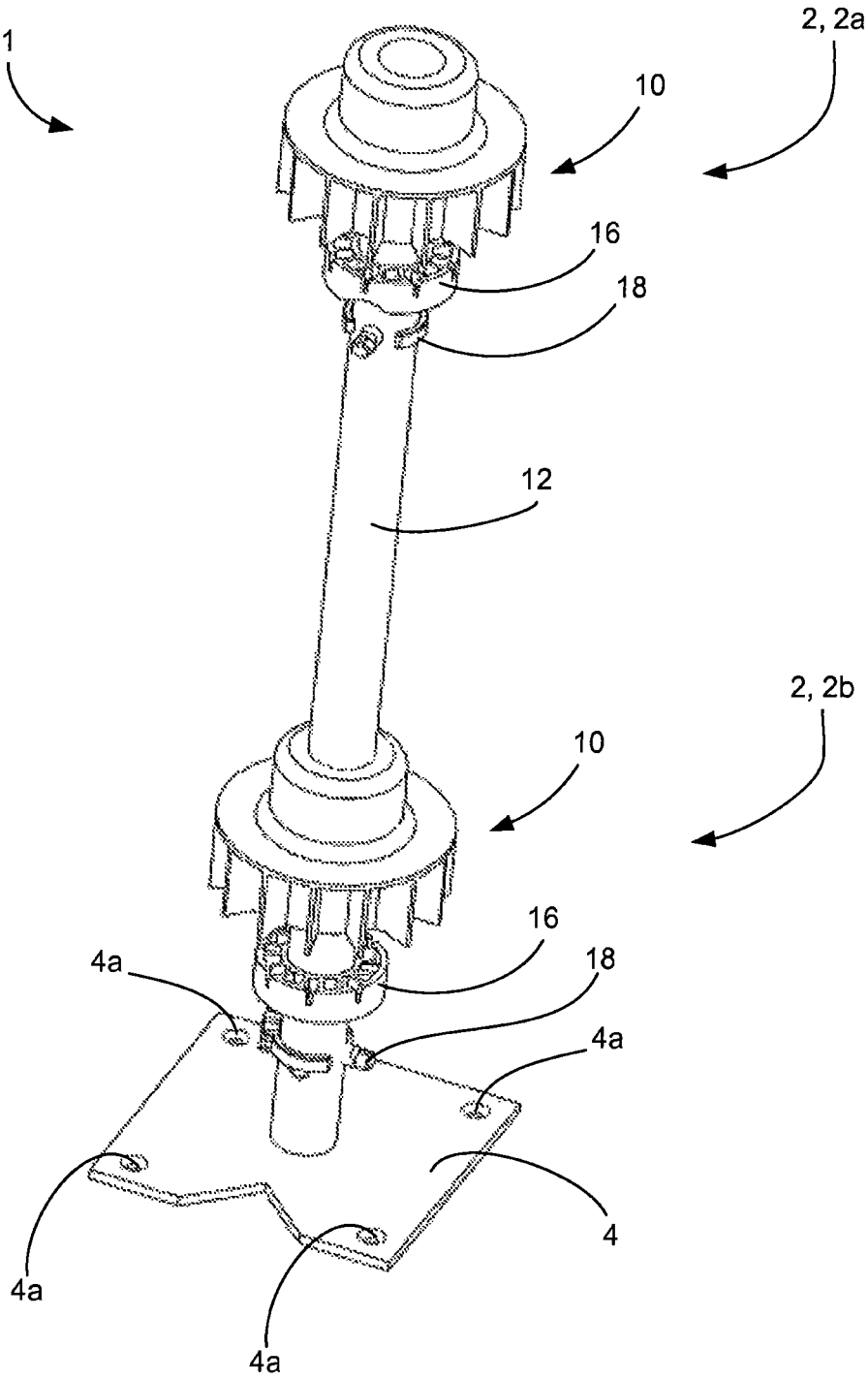
FIG. 1 is an exploded perspective view of one embodiment of the shelf system of the present invention.
Figure 2:
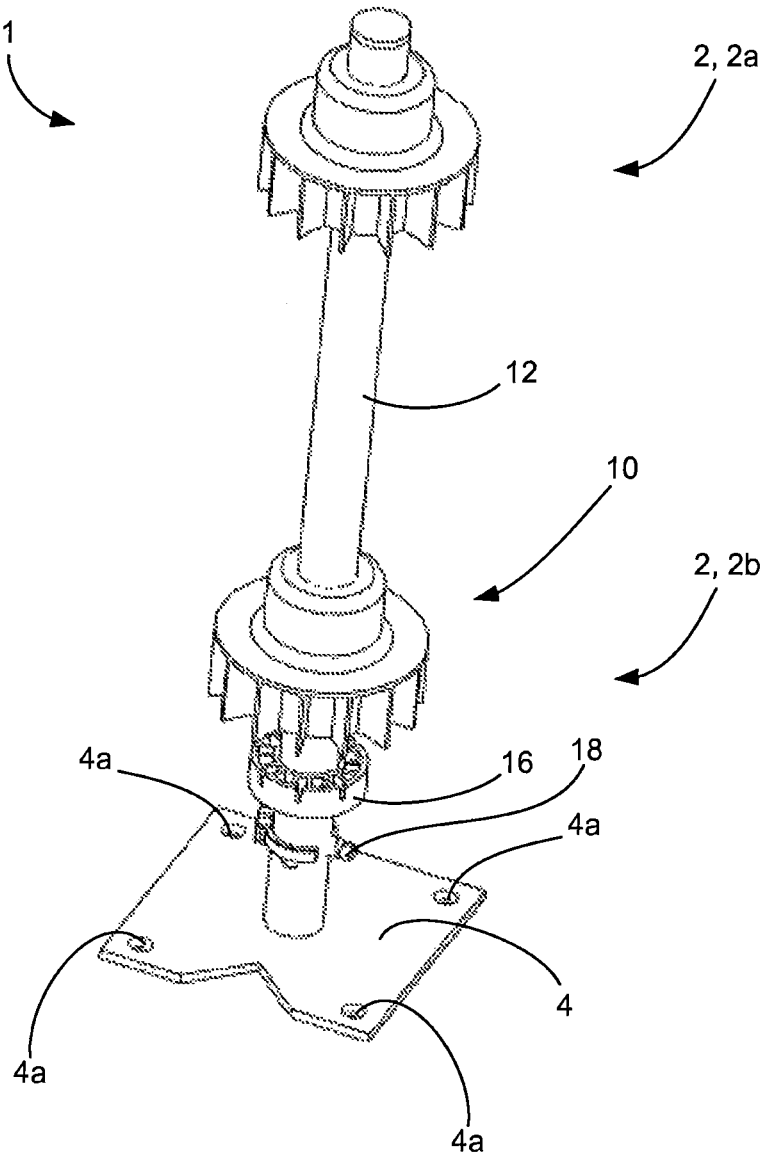
FIG. 2 is a partially exploded perspective view of the system shown in FIG. 1.

FIGS. 1 and 2 show perspective views of one embodiment of a fixed-post type of rotary shelf. Rotary shelf 1 includes a base plate 4 configured to be mounted to the floor of a cabinet through mounting apertures 4*a* defined by base plate 4. Post 12 is fixedly mounted to base plate 4. A pair of shelf systems 2*a* and 2*b* are also shown.

FIG. 1 shows systems 2*a* and 2*b* as exploded along post 12, while FIG. 2 only shows system 2*b* as exploded. As seen, system 2 includes shelf hub 10 (shelf surface not shown to facilitate illustration of other components), collar 16, and pin 18. In some embodiments, the shelf system may also be considered to include post 12.

In terms of assembly, post 12 may be mounted to a cabinet (not shown) through mounting plate 4. Pin 18 may be inserted into an aperture (see FIG. 3), and be secured simply by its own design. Collar 16 may be inserted into shelf hub 10, and the combination may be inserted onto post 12. Alternatively, collar 16 may be placed on post 12 and shelf hub 10 may be lowered down post 12 to engage collar 16. After assembly, the shelf system will rest on pin 18 and resemble system 2*a* as shown in FIG. 2. Those of ordinary skill will recognize that mounting plate 4 will preferably be mounted to the interior floor of a cabinet, yet other embodiments of the present invention will work equally as well if mounting plate 4 is mounted, for example, to the interior top of the cabinet. Additionally, while one of the benefits of the present invention is its ability to operate smoothly with only one mounting plate, those of ordinary skill in the art will recognize that other embodiments may use two mounting plates, e.g., a plate to attach to the internal floor of a cabinet and a plate to attach to the internal top of a cabinet.

Figure 3:
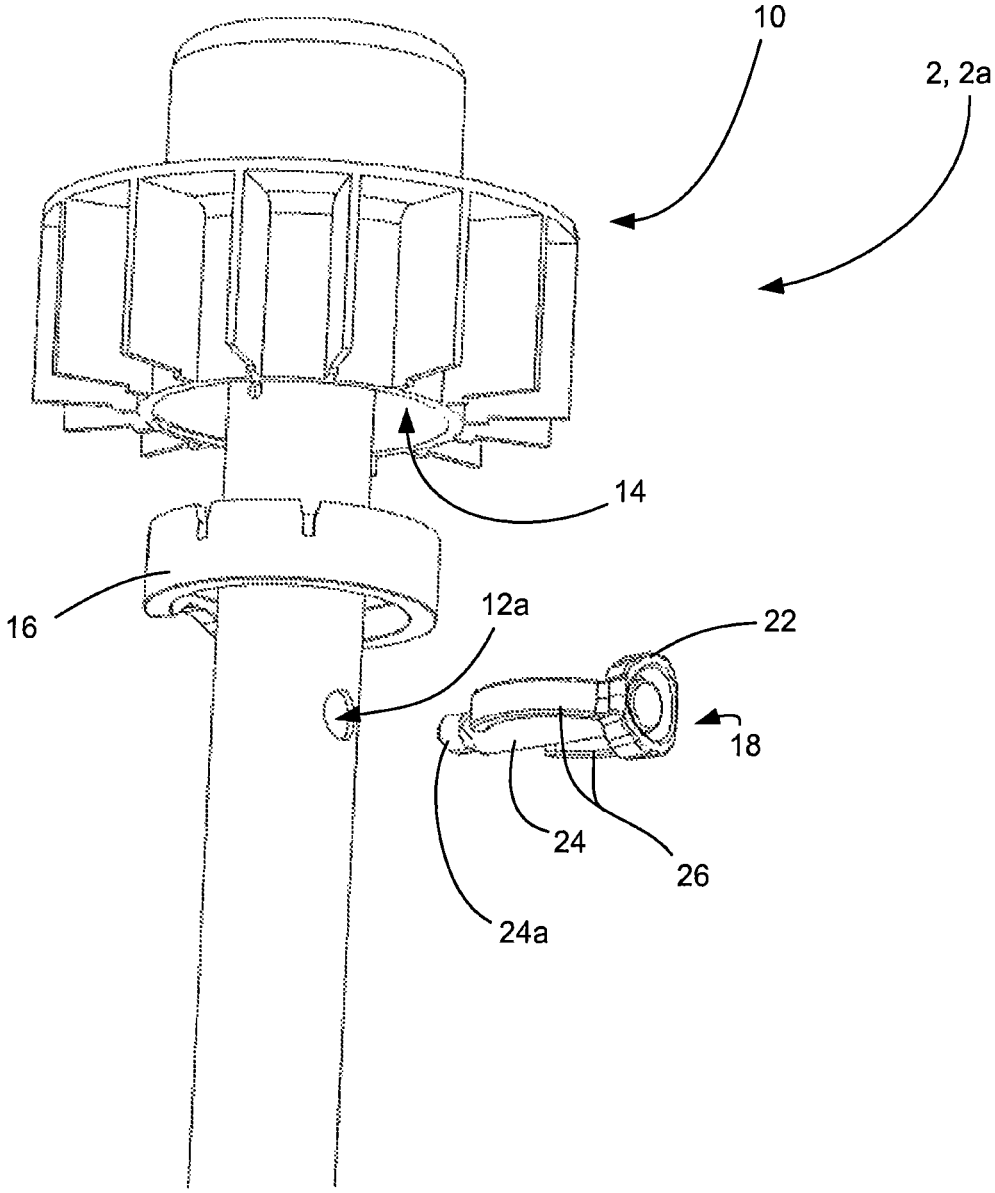
FIG. 3 is a close-up exploded perspective view of part of the system shown in FIG. 1.
Figure 4:
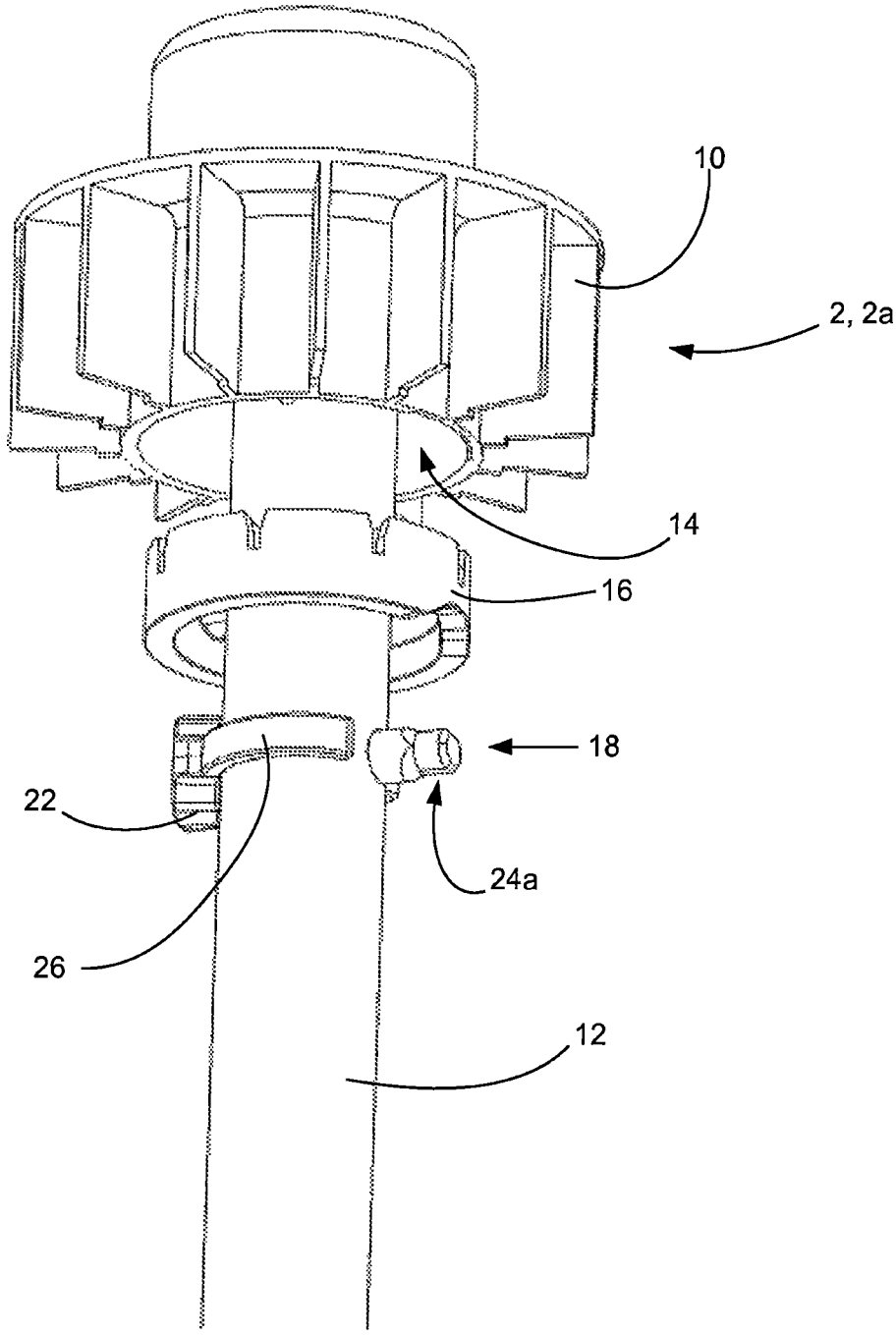
FIG. 4 is another close-up exploded perspective view of part of the system shown in FIG. 1.

FIGS. 3 and 4 show close-up perspective views of shelf system 2. Shelf hub 10 is slidably and rotatably positionable on post 12 and defines recess 14 configured to receive and engage collar 16. Collar 16 is slidably and rotatably configured to encircle post 12, and is further configured to mount within recess 14 of hub 10. While collar 16 is shown as separate from shelf hub 10, those of ordinary skill in the art will recognize that collar 16 could be integral with shelf hub 10.

Pin 18 is configured to extend through aperture 12*a* of post 12. Pin 18 has head 22, body 24, and body portion 24*a*, which extends through post 12. In this embodiment, pin 18 is configured to be self-securing by, for example, having at least one wing 26, and preferably, as shown, a pair of wings 26. Applicants have found that single wing embodiments can be self securing and provide some level of stability. These embodiments may, however, be difficult to insert into the aperture because torque generated by the single wing may disrupt the motion of the pin as it moves within the aperture. Applicants prefer a pair of wings because they have discovered that a pair of wings provides greater reduction of pin rotation within the post, provides greater stability during the rotation of the shelf, and allows for easy pin insertion into the post. Wings 26 attach at one end to pin 18 near or on head 22. Wings 26 engage post 12, for example, by being shaped to at least partially encircle post 12 when pin 18 is fully received by post 12. The flexing nature of wings 26 may further secure pin 18 frictionally to post 12.

In other embodiments, others may prefer non-self securing pins or may wish to secure their pins in other ways, or use a pin made of multiple parts. For example, some may desire to thread a pin head into a threaded aperture on one side of the post and thread a separate pin body portion onto another hole on the opposite side of the post or at another location on the post. Such embodiments are considered to be within the scope of the present invention.

Figure 5:
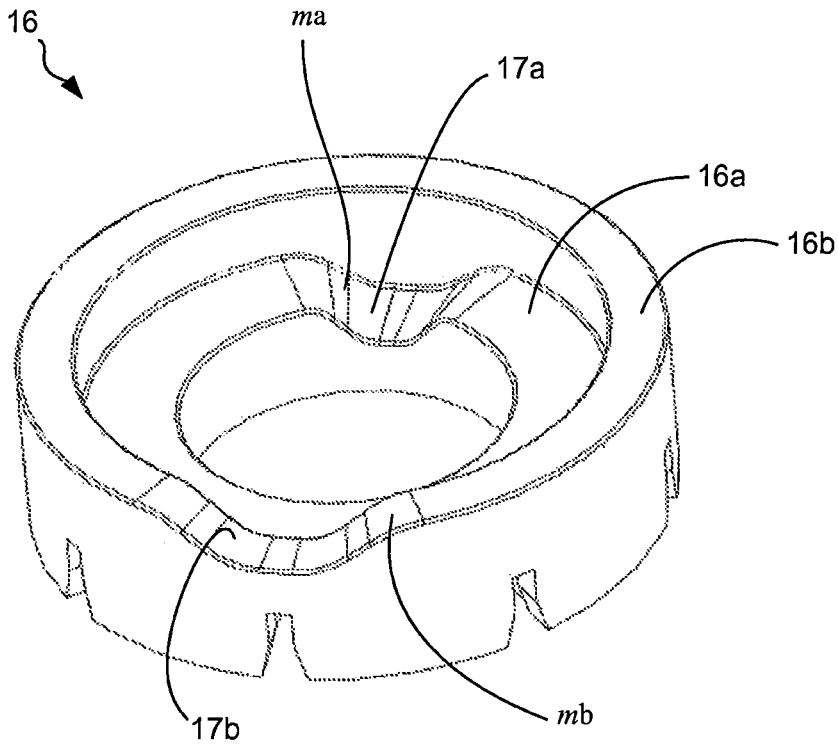
FIG. 5 is a close-up perspective view of the underneath side of the collar shown in FIG. 1.
Figure 6:
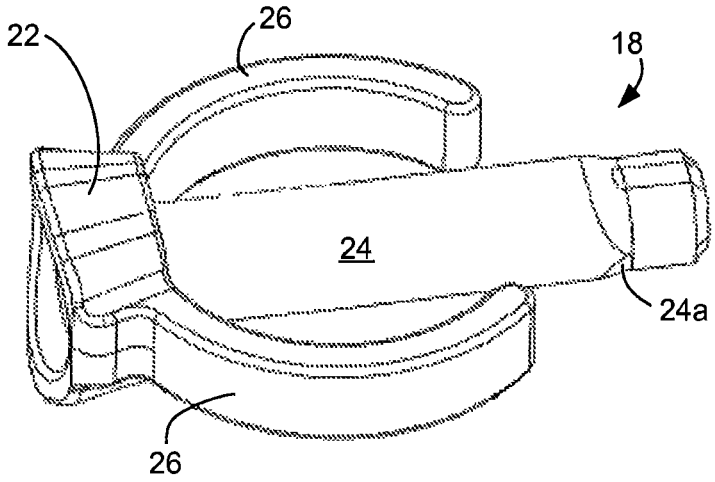
FIG. 6 is a close-up perspective view of the pin shown in FIG. 1.

Collar 16 is configured to rest on head 22 and portion 24*a* of pin 18, preferably in a substantially level position, and even more preferably in an essentially level position. FIG. 5 shows a close-up perspective view of the bottom or underneath side of collar 16, and FIG. 6 shows a close-up perspective view of pin 18. As shown, collar 16 is substantially annularly shaped and includes an inner portion 16*a* configured to engage head 22 of pin 18, and outer rim 16*b* offset from inner portion 16*a* and configured to engage portion 24*a* of pin 18. Preferably, inner portion 16*a* includes an inner indent 17*a*, and outer rim 16*b* includes an outer indent 17*b*. Preferably, inner indent 17*a* is configured to engage head 22, and outer indent 17*b* is configured to engage portion 24*a* of pin 18. In the present embodiment, the outer indent is substantially opposite of the inner indent and is offset from the inner indent. As mentioned, the portion configured to engage the pin head is an inner portion of the collar, yet others may prefer other configurations. For example, others may prefer a collar having an inner portion configured to engage pin portion 24*a* and an outer portion configured to engage the pin head. Further, inner and outer indents, in some embodiments need not be positioned substantially opposite each other. The positioning of the indents may depend, for example, on the type, shape, or number of components of the pin used. All such variations are considered to be within the scope of the present invention.

Figure 7:
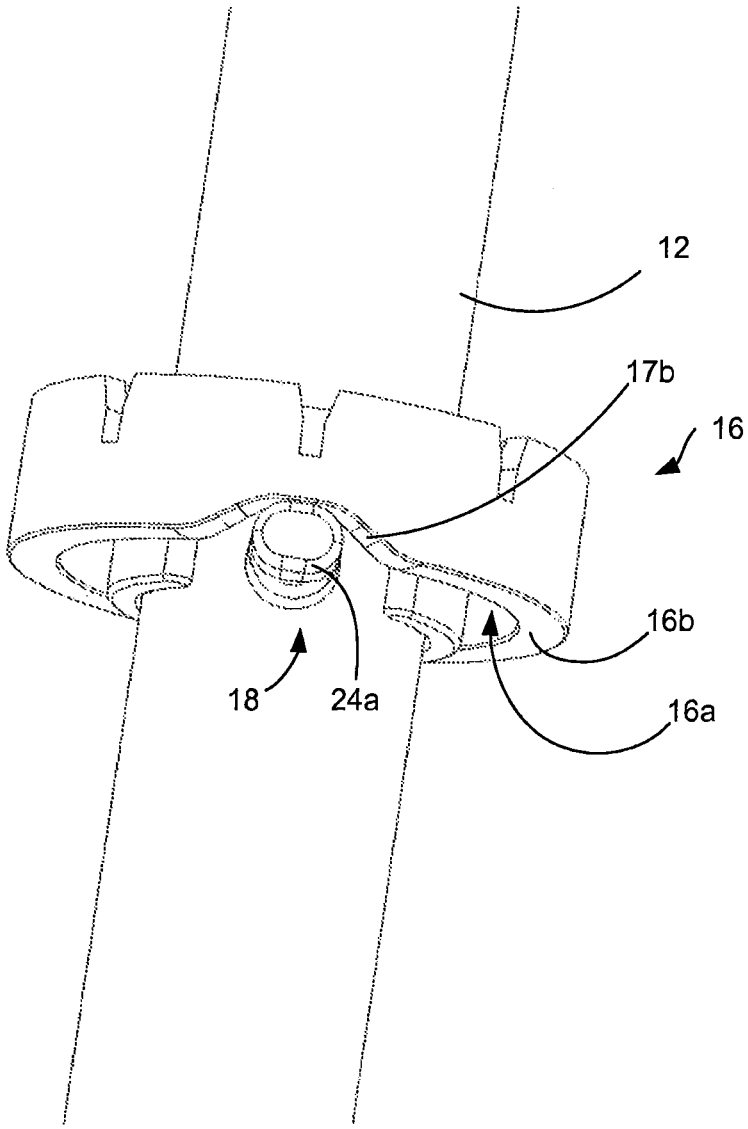
FIG. 7 is a close-up perspective view of a collar resting on a pin inserted into a post.
Figure 8:
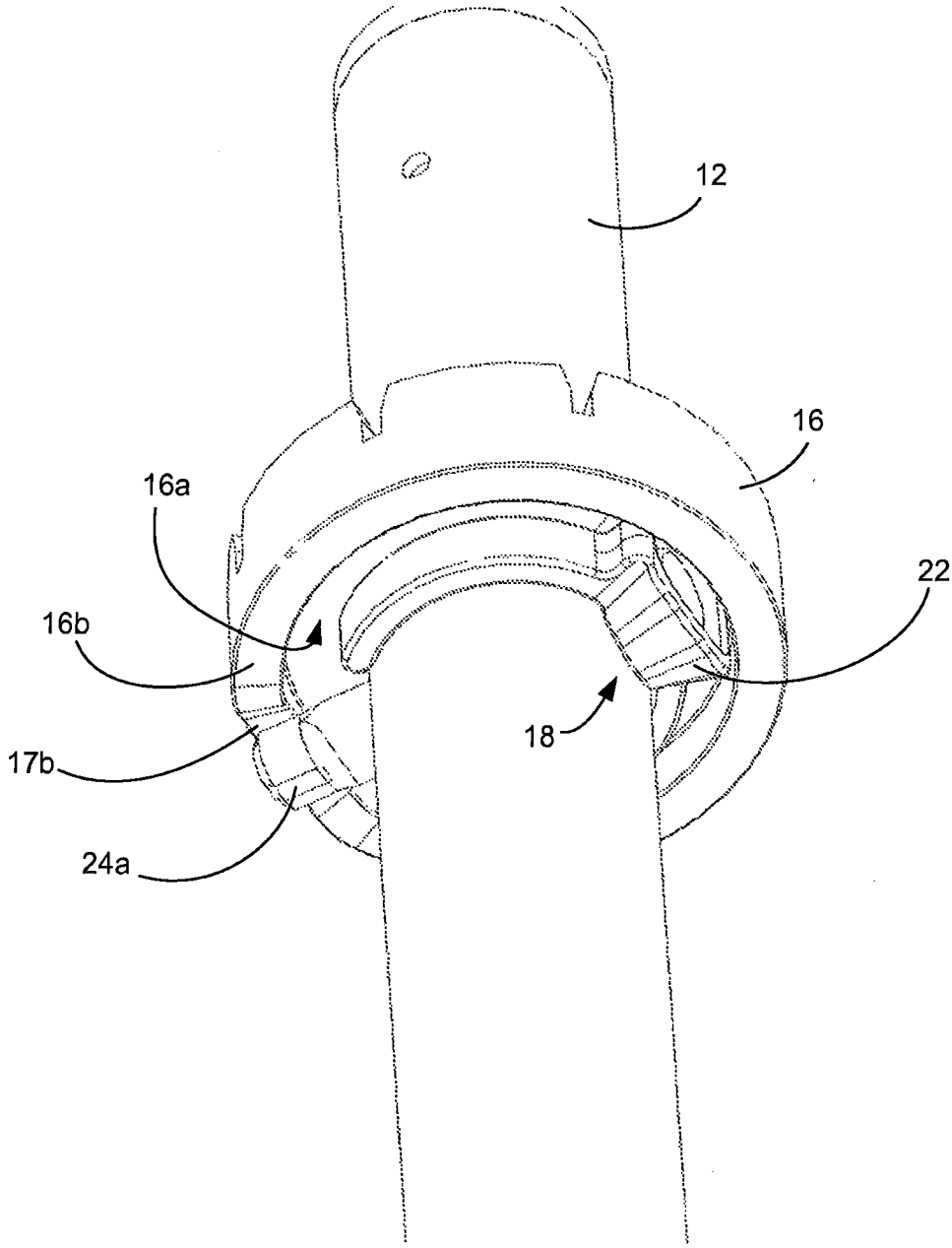
FIG. 8 is another close-up perspective view of a collar resting on a pin inserted into a post.

The combination of inner indent 17*a*, outer indent 17*b*, and the configuration of pin head 22 and body 24*a* allow for a single rest-position for hub 16 as shown in FIGS. 7 and 8. From the rest-position shown in FIGS. 7 and 8, collar 16 supported by pin 18 (and any attached shelf) can rotate around post 12 a full 360 degrees and return to the displayed rest-position without encountering a second rest-position or bump. Preferably collar 16 is supported at two points during substantially the entire rotation, and the entire rotation from the rest position is smooth, stable and level. Further, through the configuration of inner and outer indents, entry into the rest position and exit from the rest position are both smooth and stable Referring back to FIG. 5, inner indent 17*a* has a first slope ma and outer indent 17*b* has a second slope nab. In the present embodiment, the two slopes are configured to allow collar 16 to smoothly and evenly exit, and return to, the rest position (e.g., as shown in FIG. 7). Slopes of the indents may be different and may be selected, for example, to account for the difference in circumference of head 22 and pin portion 24*a*. First and second slopes are preferably selected to allow hub 16 to move into and out of the rest position (e.g., as shown in FIG. 7) with one uniform and level motion. For example, collar may lower or rotate into the rest position by allowing inner indent 17*a* to receive head 22 of pin 18, which has a first circumference, at substantially the same time outer indent 17*b* receives portion 24*a* of pin 18, which has a smaller circumference. Those of ordinary skill in the art will recognize that slopes and indent depth may be varied, for example, depending on the various circumferences of pins used or depending on the desired stability of the rest position or amount of force required to rotate out of the rest position. All such variations are considered to be within the scope of the present invention.

Figure 9:
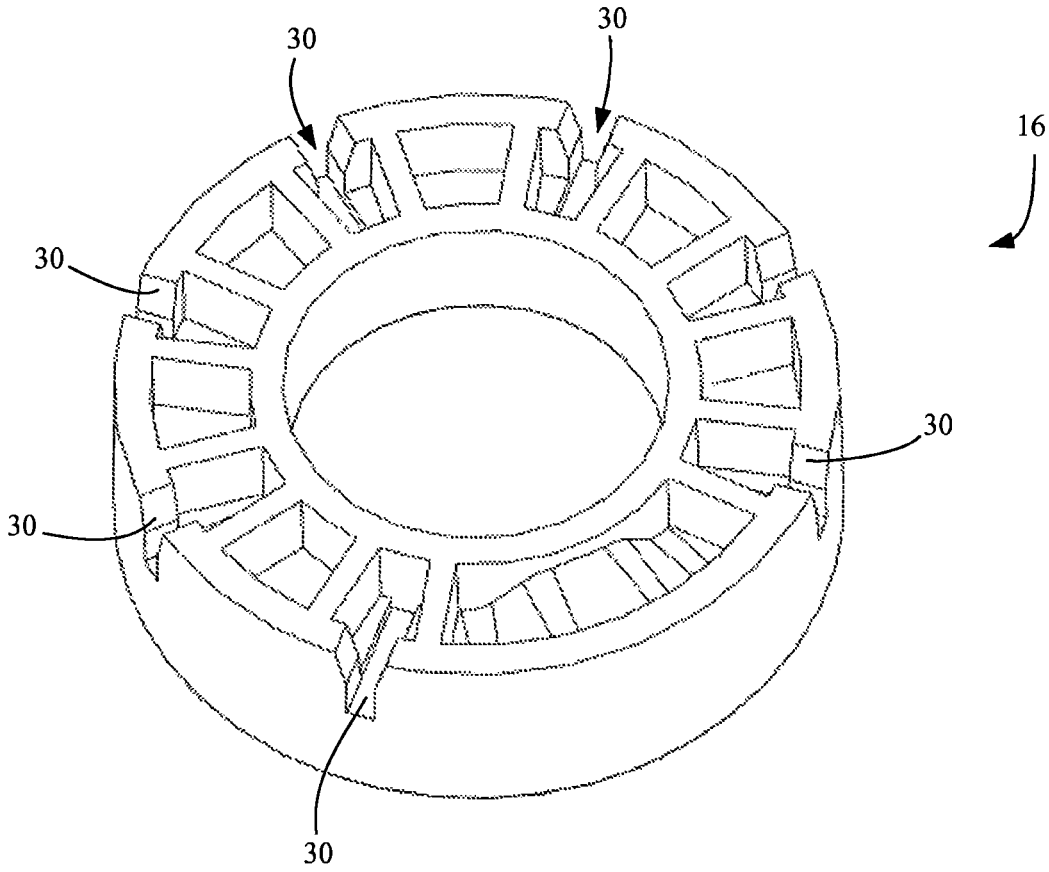
FIG. 9 is a close-up perspective view of the top of the collar shown in FIG. 1.
Figure 10:
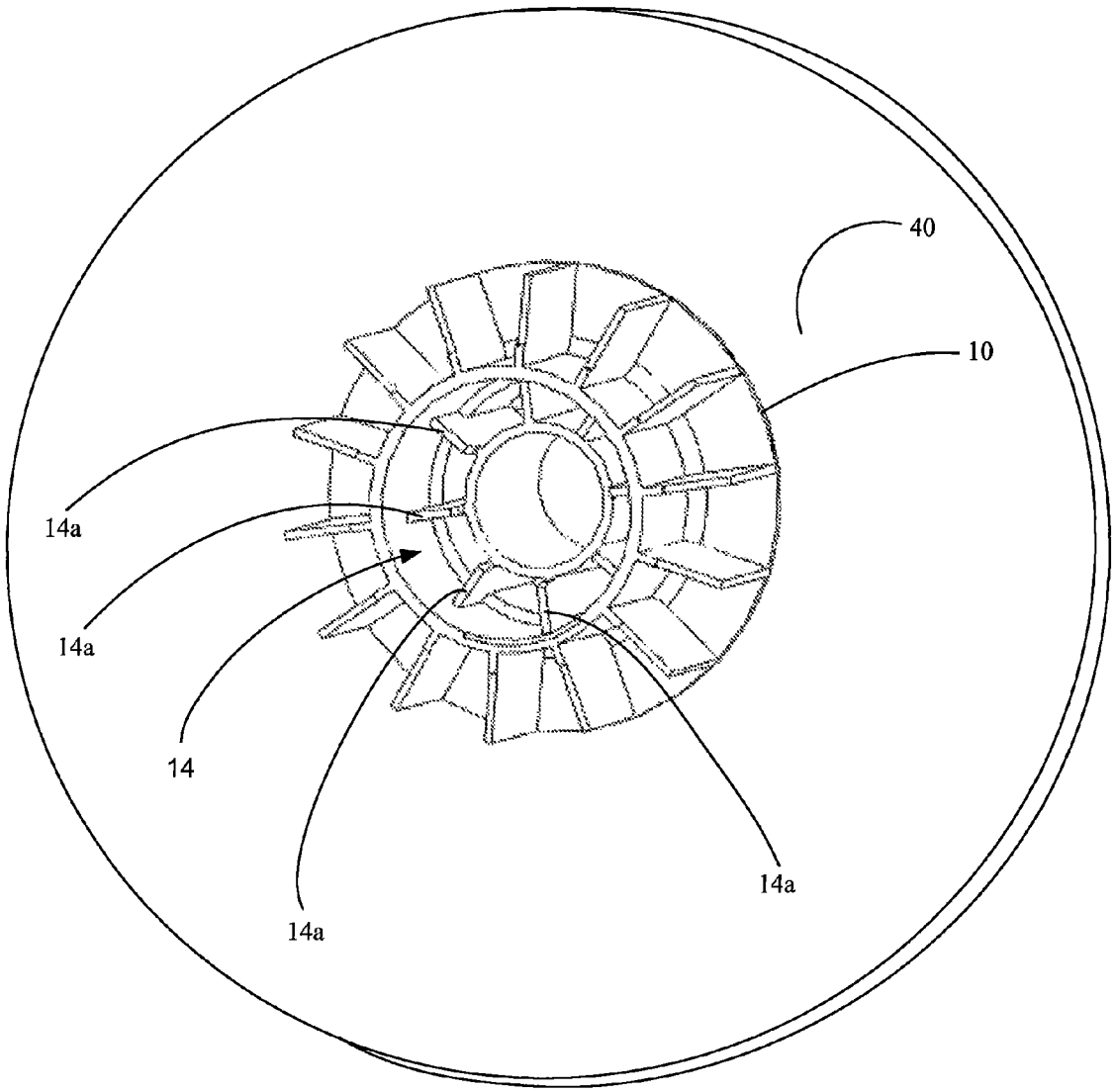
FIG. 10 is a close-up perspective view of a shelf including a shelf hub.

FIG. 9 shows a close-up perspective view of the top of collar 16 of the present invention. Collar 16 includes various slots 30 defined in the collar or top surface of the collar. FIG. 10 shows a perspective view of an underside portion of shelf 40 of the present invention. Shelf 40 includes shelf hub 10 (illustrated previously in FIGS. 1 and 2) having recess 14 configured to receive and engage collar 16. Fingers 14*a* are positioned within recess 14 and configured to engage slots 30 located on the top surface of collar 16. In some embodiments, it may be preferable to position slots and fingers at irregular intervals or by staggering, such that collar 16 will only engage hub 10 in one orientation. In other embodiments, such positioning may not be desired. Further, while applicants prefer to construct the shelf and collar as separate pieces for reasons relating to molding and shipping, those of ordinary skill in the art will recognize that they could be a single piece within the context of the present invention.

Figure 11:
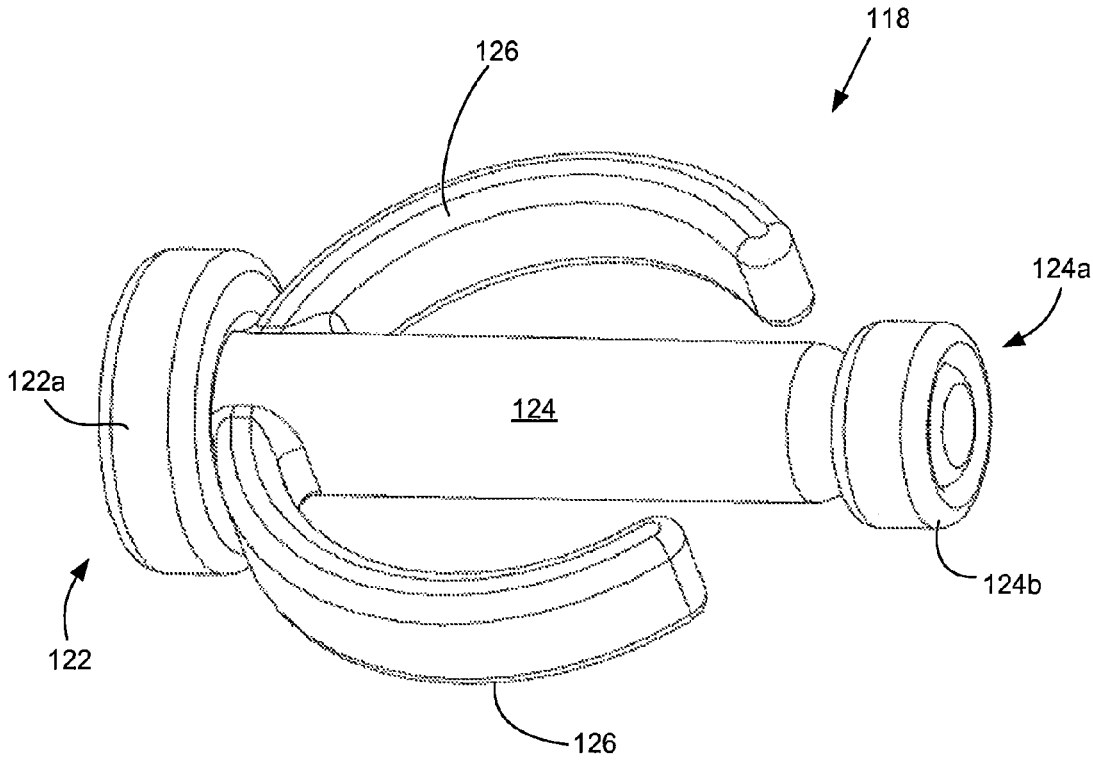
FIG. 11 is a close-up perspective view of another embodiment of a pin.

FIG. 11 shows another embodiment of a pin 118 of the present invention. In this embodiment, pin head 122 includes a roller 122*a* configured to rotate with respect to pin body 124. Wings 126 are fixedly attached at one end to body 124 and prevent pin-body rotation when pin 118 is inserted into the post. Portion of body 124*a* also includes another roller 124*b*, which is also configured to rotate with respect to pin body 124. Some may prefer rollers to reduce friction between the pin and the collar of the present invention. While two rollers are shown, those of ordinary skill in the art will recognize that other embodiments of the present invention may include either roller 122*a* or roller 124*b*.

From the preceding description, it can be seen that the present invention provides a system that meets all the advantages of related systems and offers additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of certain embodiments of the present invention. Numerous modifications and changes will readily occur to those skilled in the art, and it is not desired to limit the invention to the exact construction and operation shown and described. The present invention is intended to be limited only by the broad scope of the appended claims.

What is claimed is:

1. A shelf system for use with a post having an aperture, said system comprising: a pin having a head having a first circumference, and a body having a second circumference smaller than said first circumference, said body including a portion extended through said aperture of said post; and a collar encircled around said post and rested on said pin head having said first circumference and on said portion of said pin body extended through said post having said second smaller circumference, and wherein said collar includes a first portion encircled around said post and engaged with said head of said pin, and a second portion encircled around said post and longitudinally offset from said first portion and engaged with said portion of said pin extended through said post, wherein each of the first and second portions of the collar include flat circumferential surfaces engaging said pin and permitting 360 degree rotation of the collar relative to the post, each of the flat circumferential surfaces including only a single indent defining a single rest position, when said head of said pin is positioned in the indent on a first of the circumferential surfaces and said portion of said pin body extending through said post is positioned in the indent on a second of the circumferential surfaces.

2. The system of claim 1, wherein the single indent on the two flat circumferential surfaces are offset from each other by 180 degrees.

3. The system of claim 1, wherein the indent on the two flat circumferential surfaces engage different portions of said pin.

4. A shelf system for use with a post having an aperture, said system comprising:

a pin having a head having a first circumference, and a body having a second circumference smaller than said first circumference, said body including a portion extending through said aperture of said post: and a collar circumferentially extending around said post and resting levelly on said pin head having said first circumference and on said portion of said pin body extending through said post having said second smaller circumference, said collar including a first portion engaging said head of said pin, a second portion vertically and radially offset from said first portion and engaging said portion of said pin extending through said post, a first indent defined by said first portion of said collar, and a second indent defined by said second portion of said collar and being offset from said first indent and positioned substantially opposite said first indent, thereby creating a single rest position when said head of said pin is positioned in said first indent and said portion of said pin body extending through said post is positioned in said second indent.

5. A shelf system comprising:

a post attached to a mounting plate, said post defining at least one aperture;

a pin having a head having a first circumference and being positioned on one side of said post, and a body having a second circumference and including a portion positioned on another side of said post; and a collar encircled around said post and rested levelly on said pin head having said first circumference and on said portion of said pin body positioned on another side of said post having said second circumference, and wherein said collar includes a first portion engaged with said head of said pin, and a second portion longitudinally offset from said first portion and engaged with said portion of said pin on another side of said post;

wherein each of the first and second portions of the collar include flat circumferential surfaces and permitting 360 degree rotation of the collar relative to the post a first indent on said first portion of said collar, and a second indent on said second portion of said collar and being offset from said first indent and positioned substantially opposite said first indent, thereby creating a single rest position when said head of said pin is positioned in said first indent and said portion of said pin body extending through said post is positioned in said second indent.

* * * * *